US008348205B2

(12) United States Patent
Yang

(10) Patent No.: US 8,348,205 B2
(45) Date of Patent: Jan. 8, 2013

(54) EXPANDABLE ARMREST OF WHEEL CHAIR

(75) Inventor: Chih-Chuan Yang, Chiayi Hsien (TW)

(73) Assignee: Karma Medical Products Co., Ltd., Chiayi Hsien (TW)

( * ) Notice: Subject to any disclaimer, the term of this patent is extended or adjusted under 35 U.S.C. 154(b) by 309 days.

(21) Appl. No.: 12/882,511

(22) Filed: Sep. 15, 2010

(65) Prior Publication Data

US 2011/0278403 A1 Nov. 17, 2011

(30) Foreign Application Priority Data

May 12, 2010 (TW) ..... 99208832 U

(51) Int. Cl.
*B43L 15/00* (2006.01)

(52) U.S. Cl. ..... 248/118.1; 297/115; 297/411.3; 297/411.35

(58) Field of Classification Search ..... 248/118, 248/118.1, 118.3, 118.5, 346.07; 297/113, 297/115, 116, 411.2, 411.3, 411.35
See application file for complete search history.

(56) References Cited

U.S. PATENT DOCUMENTS

| | | | | |
|---|---|---|---|---|
| 5,522,572 | A * | 6/1996 | Copeland et al. | 248/118 |
| 5,752,683 | A * | 5/1998 | Novis et al. | 248/118 |
| 5,971,484 | A * | 10/1999 | Lamart et al. | 297/411.37 |
| 6,168,237 | B1 * | 1/2001 | Lamart et al. | 297/411.37 |
| 2002/0060277 | A1 * | 5/2002 | Tsai et al. | 248/118 |
| 2004/0206858 | A1 * | 10/2004 | Rockafellow et al. | 248/118 |
| 2008/0191104 | A1 * | 8/2008 | Wang | 248/118 |

* cited by examiner

*Primary Examiner* — Bradley Duckworth
(74) *Attorney, Agent, or Firm* — Rosenberg, Klein & Lee

(57) ABSTRACT

An expandable armrest of a wheel chair includes a fixed part having a first pivotal portion which includes a first pivotal hole. A movable part is pivotably connected to the first pivotal portion of the fixed part by its second pivotal portion. A first transverse hole and a second transverse hole are defined in the second pivotal portion. A slide member is slidably inserted into the slots of the second pivotal portion and has an inclined hole in which an engaging member is engaged. The engaging member has a first end and a second end. A trace that the engaging member moves in the inclined hole constantly intersects a trace that the first end moves in the first transverse hole and a trace that the second end moves in the second transverse hole, such that the movable part is positioned by controlling the movement of the slide member.

4 Claims, 9 Drawing Sheets

C-C

C-C

EXPANDABLE ARMREST OF WHEEL CHAIR

FIELD OF THE INVENTION

The present invention relates to an expandable armrest of a wheel chair, and more particularly, to a movable part which is slidably expanded and flush with a fixed part of an armrest so as to increase the area for the arm to be rested on.

BACKGROUND OF THE INVENTION

A conventional wheel chair includes two armrests on two sides thereof so that the user can rest his/her arms on the armrests. The armrest known to applicant includes a support frame which has one end connected to a pivotal member and the pivotal member is pivotably connected with a link. A pad is connected to the link. The pivotal member has a head and the link has a U-shaped portion pivotably connected to the head of the pivotal member. The head that is connected with the U-shaped portion has a curved hole and a restriction member which extends through the curved hole and is movable in the curved hole, such that the armrest can be folded.

However, the conventional armrest can only fold but cannot increase its area for the user so that the user might feel uncomfortable by the limited area of the armrest.

The present invention intends to provide an expandable armrest that provides a larger area for the user when needed.

SUMMARY OF THE INVENTION

The present invention relates to an expandable armrest of wheel chair, and comprises a fixed part which has a first pivotal portion having a first pivotal hole. A shaft is inserted into the first pivotal hole. The first pivotal portion has an engaging hole and a protrusion is located beside the engaging hole. The protrusion has an inclined surface. A movable part is pivotably connected to the first pivotal portion of the fixed part and has a second pivotal portion which includes a second pivotal hole and a through hole. The second pivotal portion has two slots defined therein. A first transverse hole and a second transverse hole are defined in the second pivotal portion. A slide member is slidably inserted into the slots and connected with a resilient member. The resilient member has a first hook and a second hook. The first hook is hooked to the movable part and the second hook is hooked to the slide member. The slide member has an inclined hole which is located corresponding to the first and second transverse holes. An engaging member is engaged with the inclined hole of the slide member and has a first end and a second end. The first end is movably engaged with the first transverse hole and the second end is movably engaged with the second transverse hole. A trace that the engaging member moves in the inclined hole constantly intersects a trace that the first end moves in the first transverse hole and a trace that the second end moves in the second transverse hole. The engaging member has a bar which is perpendicular to the first and second ends. The bar extends out from the through hole and is engaged with the engaging hole of the fixed part.

Preferably, the fixed part has a first pad connected thereto.

Preferably, the movable part has a second pad connected thereto. Preferably, the first pivotal portion has a connection member.

The present invention includes the following advantages:

1. The present invention is able to increase the area of the armrest so that the user feels comfortable when his/her arm is rested on the first and second pads.

2. When the movable part is not in use, it is easily flipped downward and does not occupy space.

3. The operation of the present invention is easy, simple and energy-saved, which is suitable for disables.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
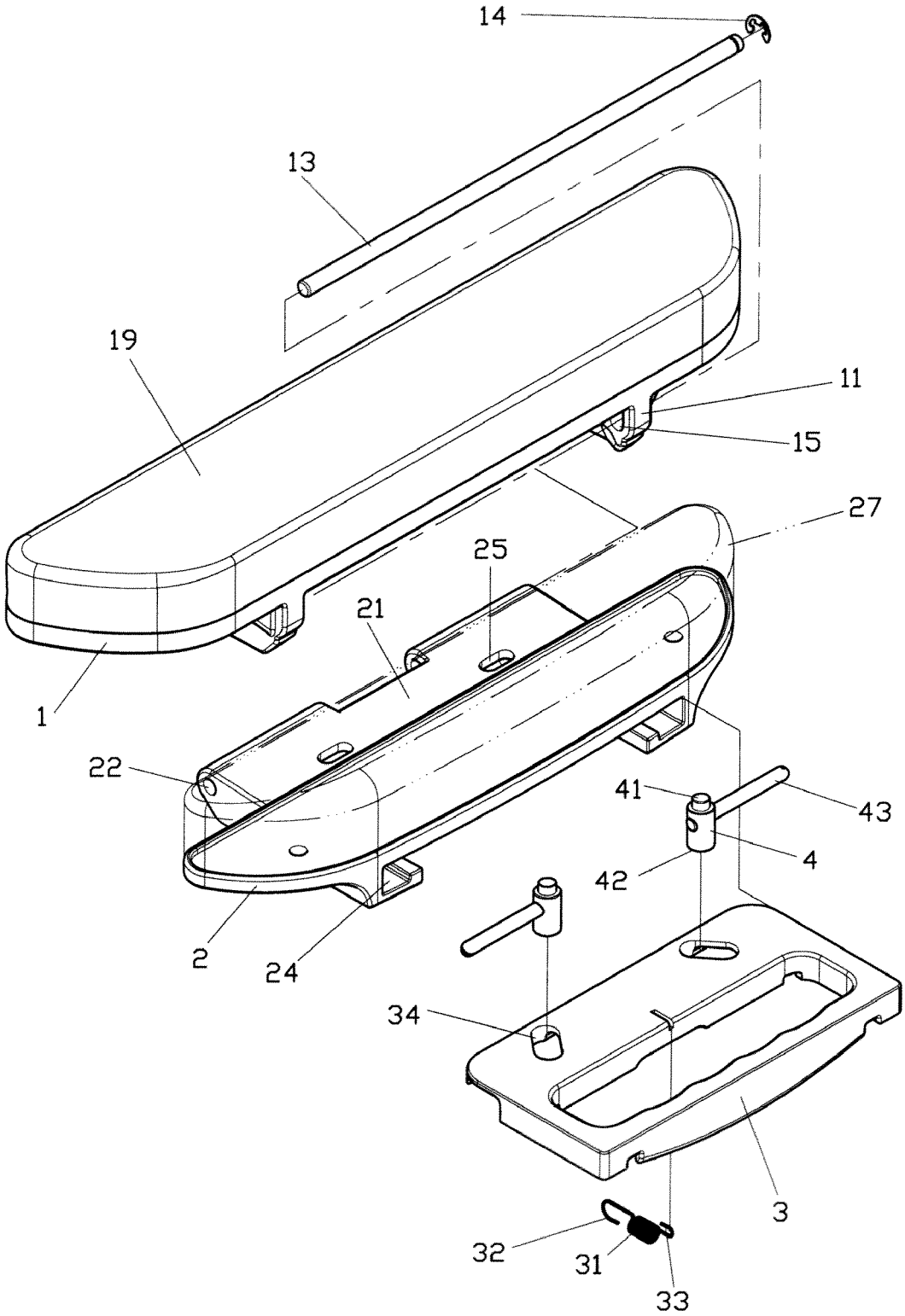
FIG. 1 is an exploded view to show the expandable armrest of the present invention.
Figure 2:
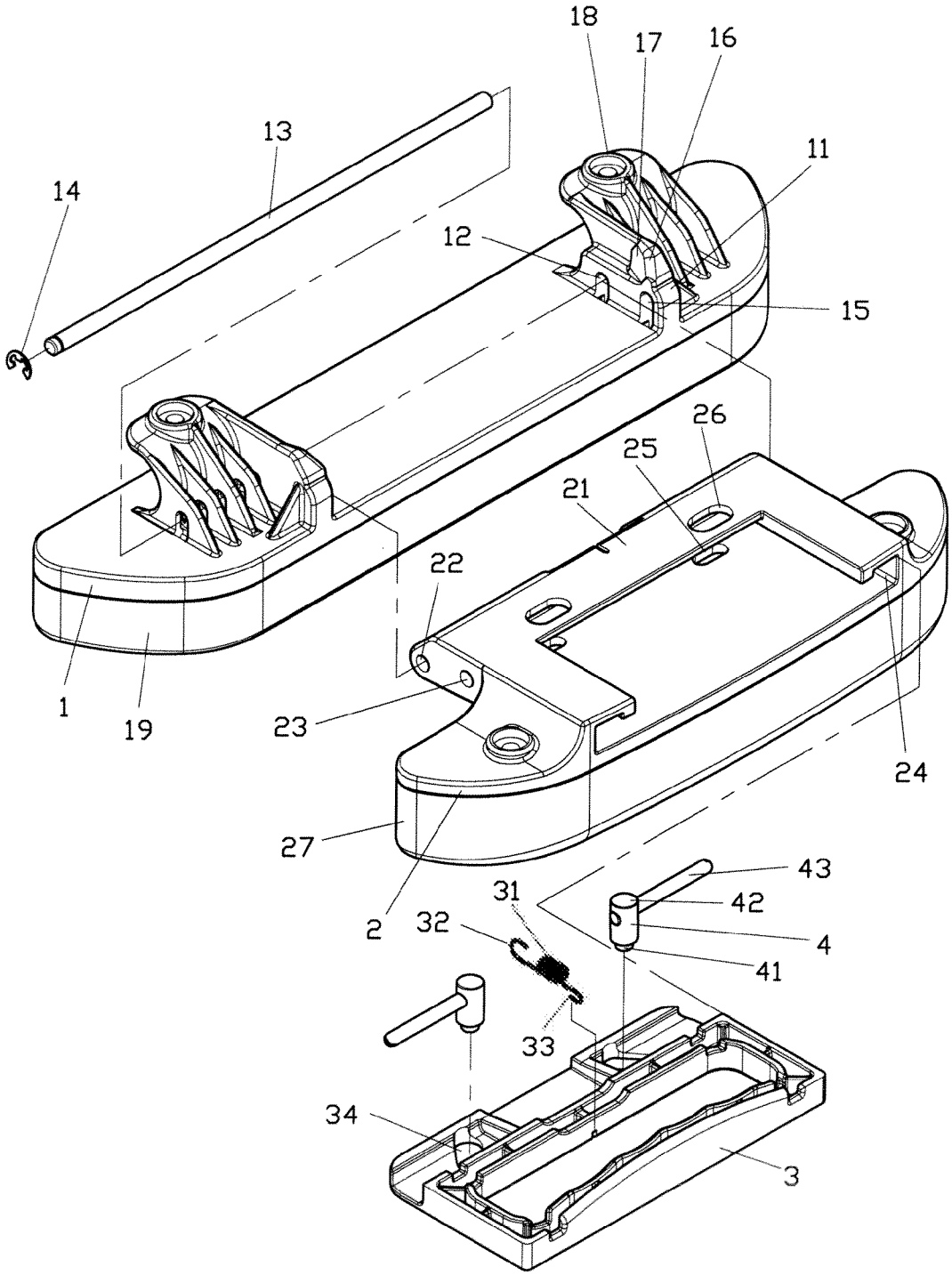
FIG. 2 is another exploded view to show the expandable armrest of the present invention.
Figure 3:
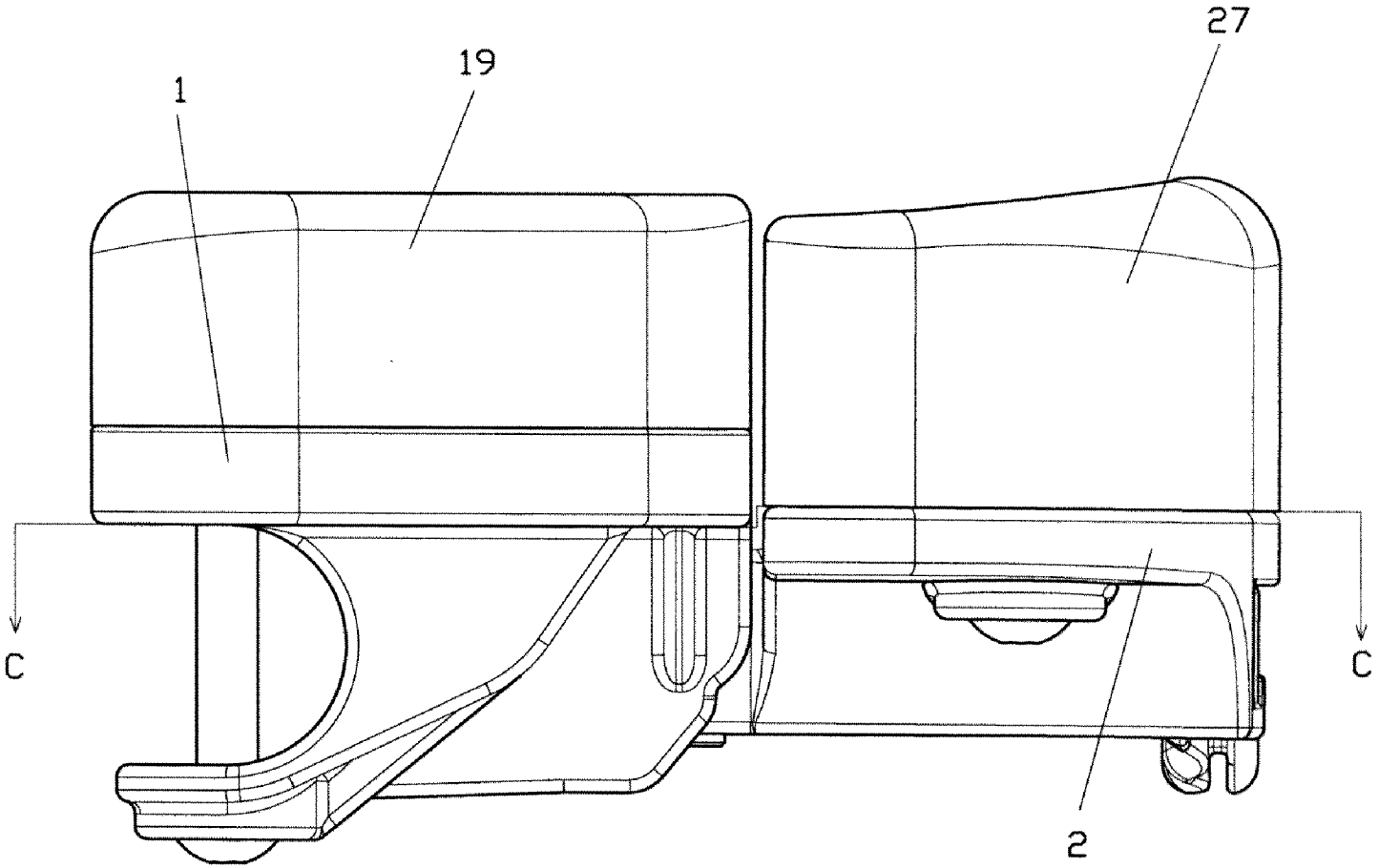
FIG. 3 is a perspective view to show the expandable armrest of the present invention.

Referring to FIGS. 1 to 3, the present invention comprises a fixed part 1, a movable part 2, a slide member 3 and two engaging members 4.

The fixed part 1 has two first pivotal portions 11 on the bottom thereof and each of the first pivotal portions 11 includes a first pivotal hole 12. A shaft 13 is inserted into the two first pivotal holes 12. A C-shaped clip 14 is connected to one end of the shaft 13. The two first pivotal portion 11 each have an engaging hole 15 and a protrusion 16 is located beside the engaging hole 15. The protrusion 16 has an inclined surface 17 which faces the engaging hole 15. Each of the first pivotal portions 11 has a connection member 18 and the fixed part 1 has a first pad 19 connected on a top thereof.

The movable part 2 is pivotably connected to the first pivotal portions 11 of the fixed part 1 and has a second pivotal portion 21 which includes a second pivotal hole 22 and a through hole 23 on each of two sides thereof. The shaft 13 extends through the second pivotal holes 22. The second pivotal portion 21 has two slots 24 defined therein. A first transverse hole 25 and a second transverse hole 26 are respectively defined in the top and the bottom of the second pivotal portion 21. The movable part 2 has a second pad 27 connected to a top thereof.

The slide member 3 is slidably inserted into the slots 24 of the movable part 2 and is connected with a resilient member 31. The resilient member 31 has a first hook 32 and a second hook 33. The first hook 32 is hooked to the movable part 2 and the second hook 33 is hooked to the slide member 3, such that the slide member 3 is movable in the slots 24 of the movable part 2. The slide member 3 has two inclined holes 34 which are located corresponding to the first and second transverse holes 25, 26.

Figure 4:
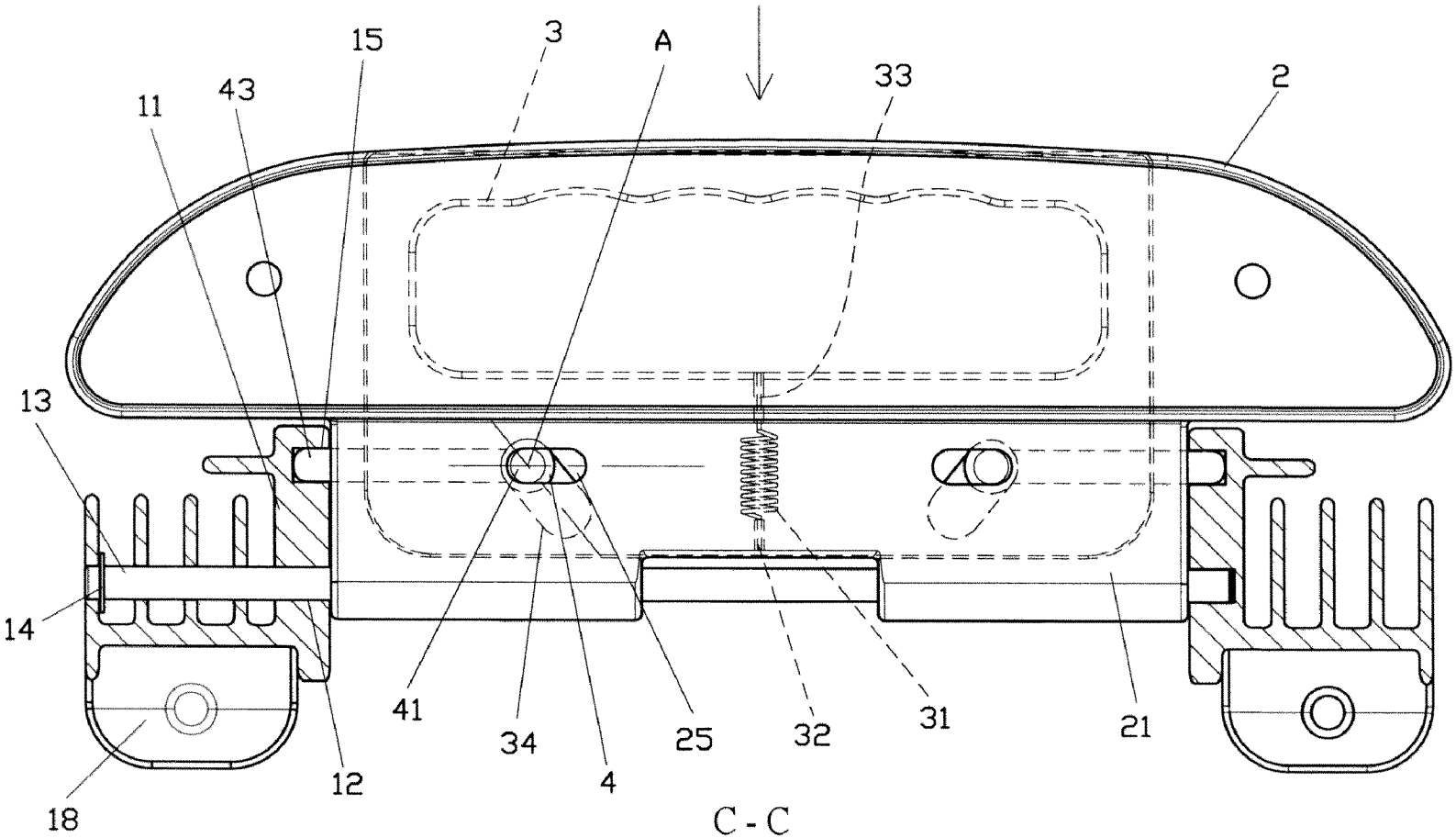
FIG. 4 is a cross sectional view, taken alone line C-C in FIG. 3.

The two engaging members 4 are engaged with the inclined holes 34 of the slide member 3 and each have a first end 41 and a second end 42. The first end 41 is movably engaged with the first transverse hole 25 corresponding thereto and the second end 42 is movably engaged with the second transverse hole 26 corresponding thereto. The trace that the engaging member 4 moves in the inclined hole 34 constantly intersects the trace that the first end 41 moves in the first transverse hole 25 and the trace that the second end 42 moves in the second transverse hole 26 as shown in FIG. 4. The intersection point is point "A" which is located close to the two remote ends of the two first transverse holes 25 and the two second transverse holes 26. The engaging members 4 each have a bar 43 which is perpendicular to the first and second ends 41, 42. The bars 43 extend out from the through holes 23 and are engaged with the engaging holes 15 of the fixed part 1.

Figure 5:
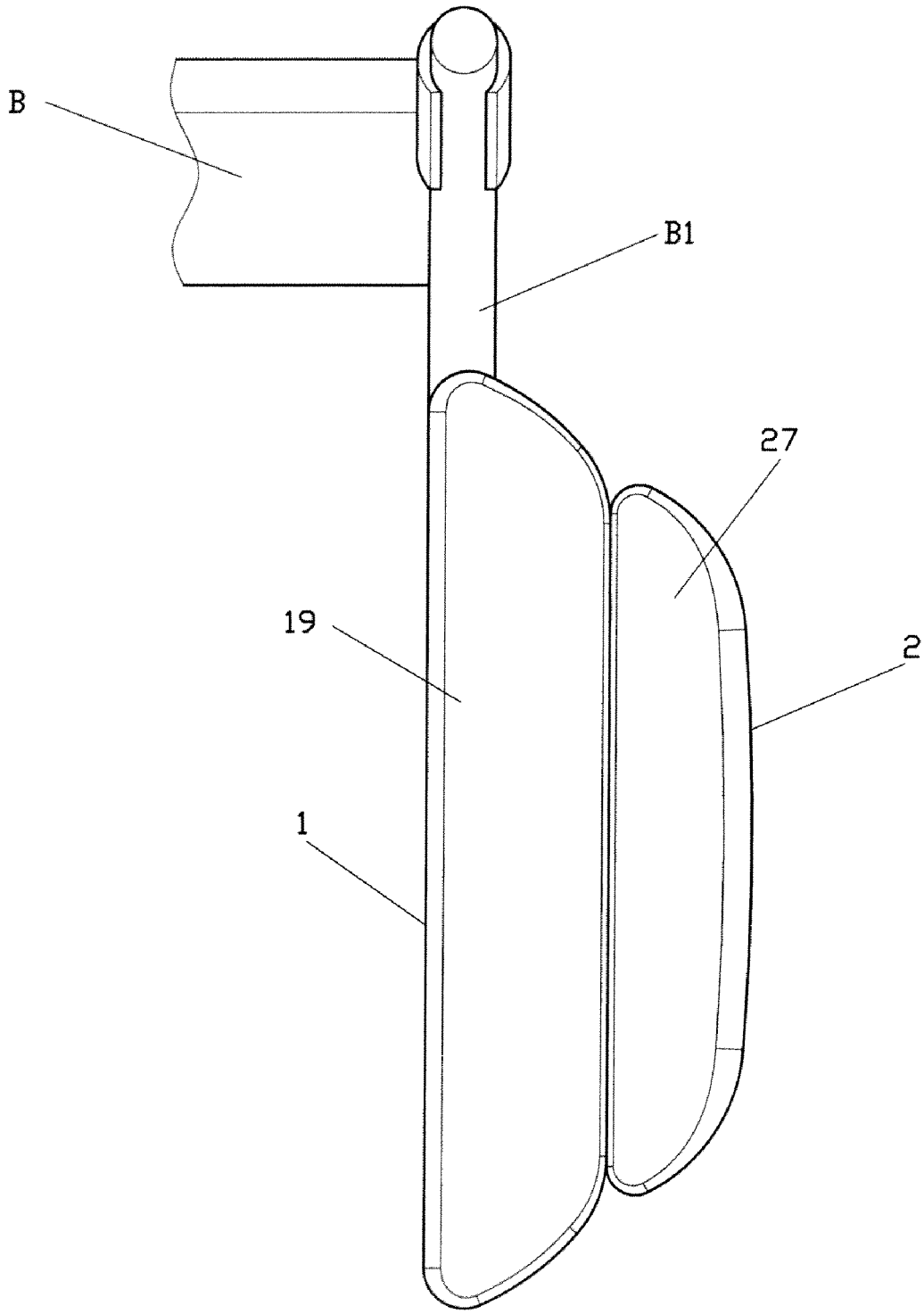
FIG. 5 shows that the fixed part is fixed to the armrest of the wheel chair.

When assembling, as shown in FIG. 5, the fixed part 1 is fixed to the armrest B1 of the wheel chair B by the connection members 18, and the fixed part 1 is in flush with the movable part 2 so as to increase the area such that the user's arm is rested on the first and second pads 19, 27 comfortably.

Figure 6:
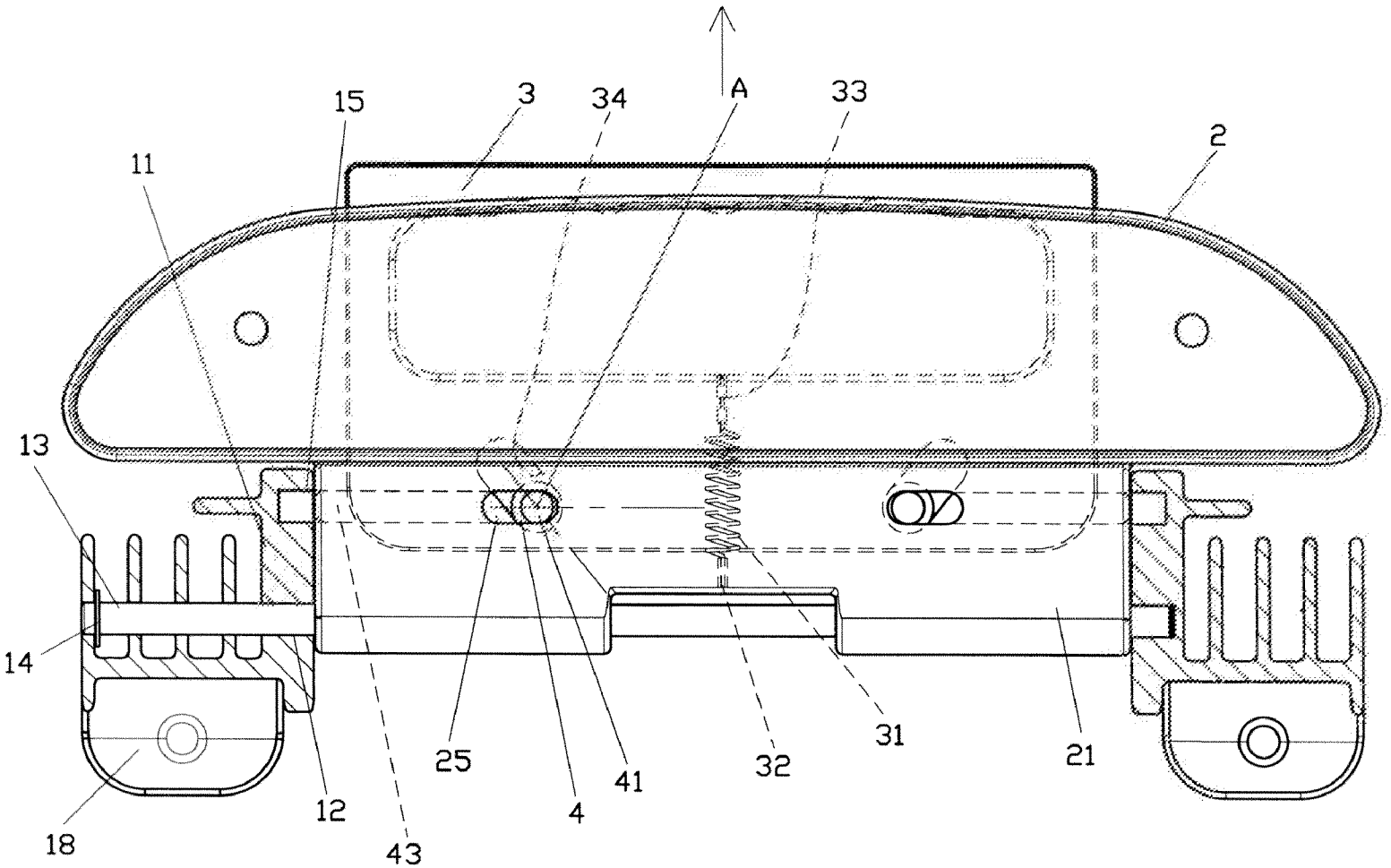
FIG. 6 shows that the slide member is pulled out from the slots of the movable part.

When the movable part 2 is not in use and to be pivoted downward, as shown in FIG. 6, the user may pull the slide member 3 outward from the slots 24 of the movable part 2. When the slide member 3 is pulled, the resilient member 31 is pulled and the positions of the inclined holes 34 are moved with the movable part 2. The first end 41 of the engaging member 4 in the first transverse hole 25, and the second end 42 of the engaging member 4 in the second transverse hole 26 respectively move along their traces. When the engaging members 4 move along the traces in the inclined holes 34, the point "A" of the three traces of the inclined hole 34, the first transverse hole 25 and the second transverse hole 26 will move inward from the remote ends of the first and second transverse holes 25, 26. The bars 43 are retracted into the through holes 23 and do not engaged with the engaging holes 15 of the fixed part 1. Therefore, the movable part 2 is easily flipped downward and perpendicular to the fixed part 1. When the force is removed from the slide member 3, the slide member 3 returns back to its original position by the force of the resilient member 31. The trace of the engaging member 4 in the inclined hole 34 changes and the point "A" with the two respective traces of the first transverse hole 25 and the second transverse hole 26 moves back to its original position. This brings the engaging member 4 back to its original position and the bar 43 is still extended out from the through hole 23.

Figure 7:
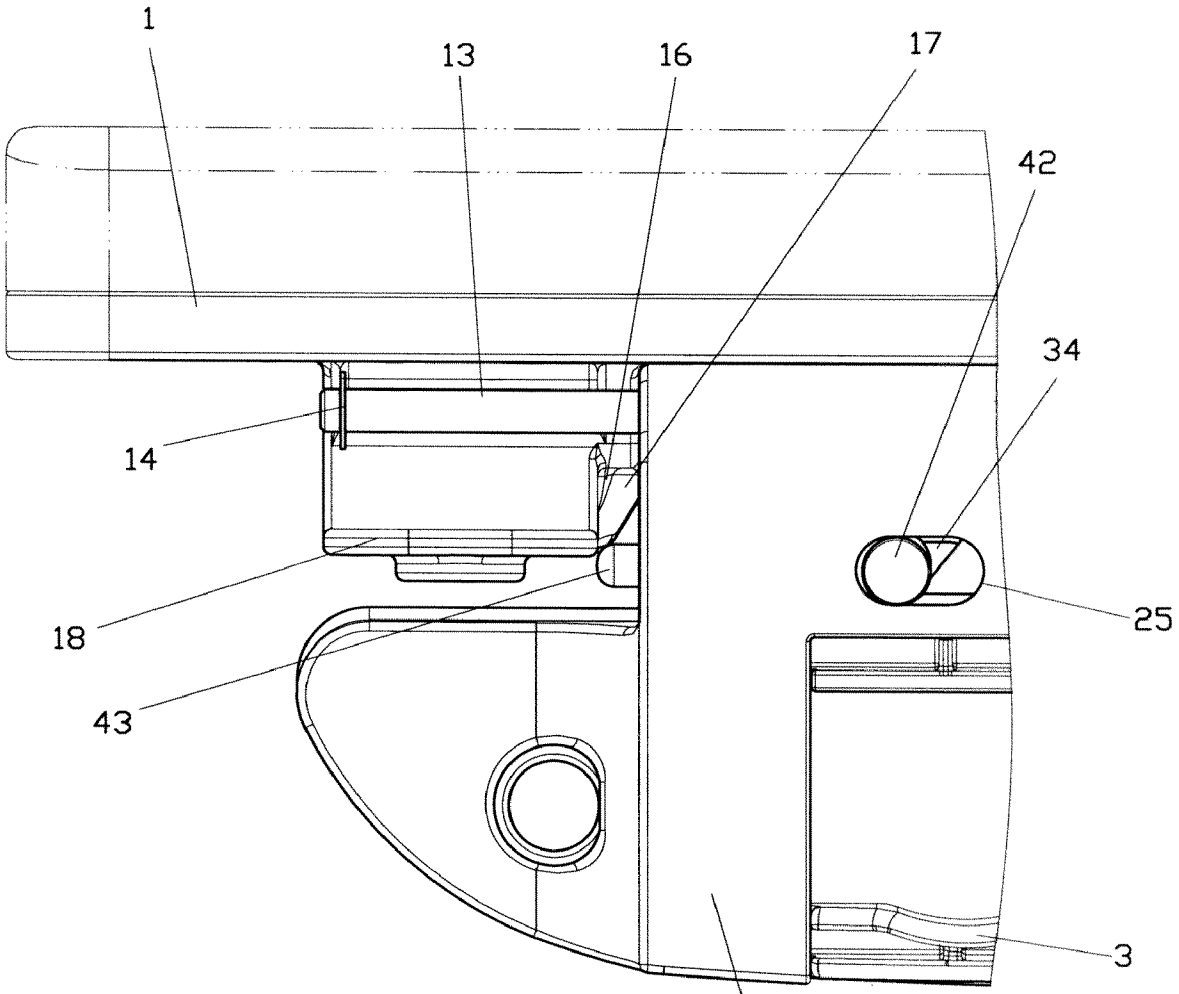
FIG. 7 shows that the movable part is flipped relative to the fixed part.
Figure 8:
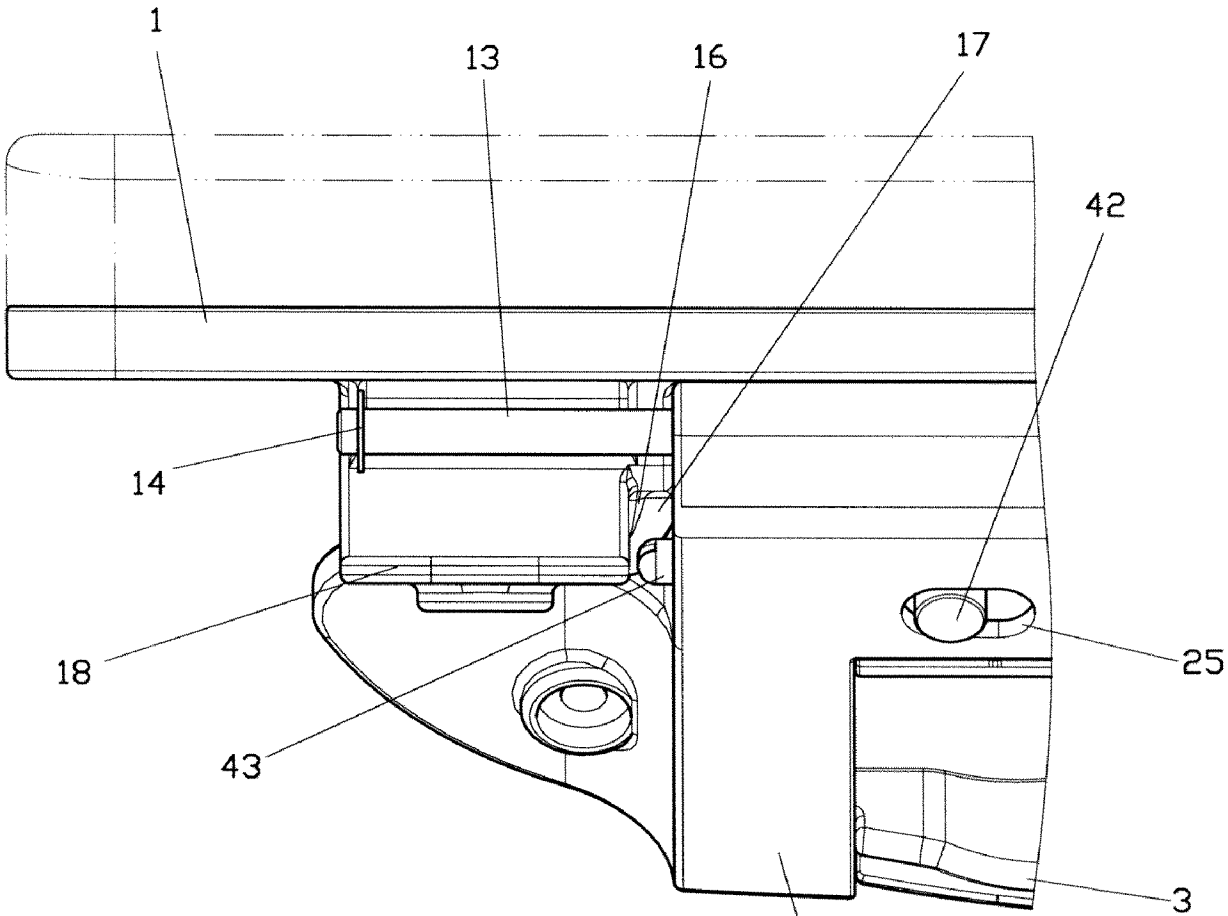
FIG. 8 shows the bar is stopped by the inclined surface of the protrusion and is retracted.
Figure 9:
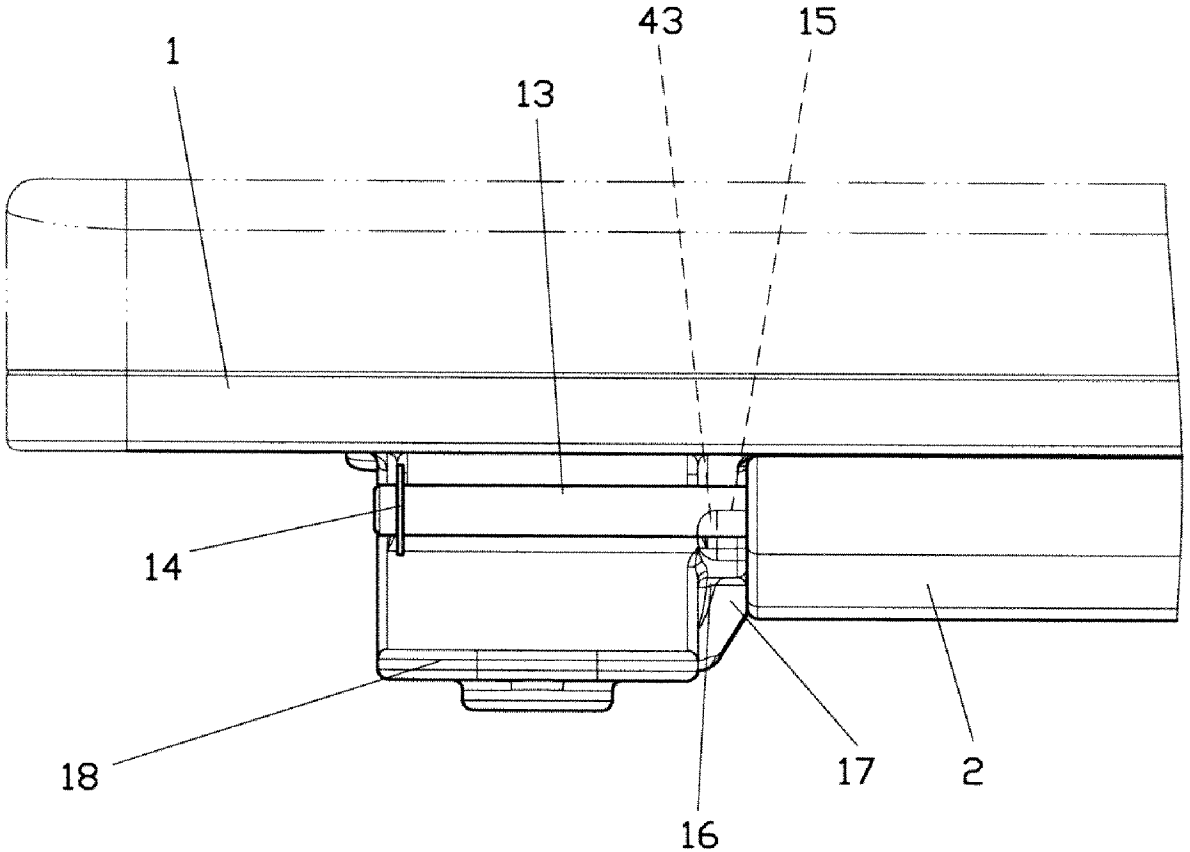
FIG. 9 shows that the bar is not stopped by the inclined surface and engaged with the engaging hole of the fixed part.

When the user wants to use the movable part 2, as shown in FIG. 7, simply pivots the movable part 2 upward relative to the fixed part 1 about the shaft 13 in the first pivotal hole 12 of the fixed part 1 and the second pivotal hole 22 of the movable part 2. When the movable part 2 is pivoted, the bars 43 extended out from the through holes 23 contact the protrusions 16 of the fixed part 1 as shown in FIG. 8. The bars 43 are stopped by the inclined surfaces 17 of the protrusions 16, and gradually retracted inward to move the engaging members 4. This makes the trace of the engaging member 4 in the inclined hole 34 change, and the point "A" that the trace of the engaging member 4 intersects the two respective traces of the first transverse hole 25 and the second transverse hole 26 changes too. The point "A" moves inward from the remote ends of the first and second transverse holes 25, 26. The slide member 3 is moved outward in the slots 24 by the movement of the engaging members 4, and the resilient member 31 is pulled, until the movable part 2 is pivoted to a position which is flush with and parallel to the fixed part 1. The bars 43 are removed from the inclined surfaces 17 of the protrusions 16 and the slide member 3 moves back to its original position by the force of the resilient member 31. In the meanwhile, the engaging members 4 move along the traces in the inclined holes 34. The point "A" that the trace of the engaging member 4 intersects the two respective traces of the first transverse hole 25 and the second transverse hole 26 moves to its original position as shown in FIG. 4. This brings the engaging members 4 back to original positions and the bars 43 extend out from the through holes 23 again as shown in FIG. 9, and engaged with the engaging holes 15 of the fixed part 1. The fixed part 1 and the movable part 2 are then flush with each other in parallel to increase the area for the user's arm to rest on.

While we have shown and described the embodiment in accordance with the present invention, it should be clear to those skilled in the art that further embodiments may be made without departing from the scope of the present invention.

What is claimed is:

1. An expandable armrest of wheel chair, comprising:

a fixed part having a first pivotal portion which includes a first pivotal hole, a shaft inserted into the first pivotal hole, the first pivotal portion having an engaging hole and a protrusion located beside the engaging hole, the protrusion having an inclined surface;

a movable part pivotably connected to the first pivotal portion of the fixed part and having a second pivotal portion which includes a second pivotal hole and a through hole, the second pivotal portion having two slots defined therein, a first transverse hole and a second transverse hole defined in the second pivotal portion;

a slide member slidably inserted into the slots and connected with a resilient member, the resilient member having a first hook and a second hook, the first hook hooked to the movable part and the second hook hooked to the slide member, the slide member having an inclined hole which is located corresponding to the first and second transverse holes, and an engaging member engaged with the inclined hole of the slide member and having a first end and a second end, the first end movably engaged with the first transverse hole and the second end movably engaged with the second transverse hole, a trace that the engaging member moves in the inclined hole constantly intersecting a trace that the first end moves in the first transverse hole and a trace that the second end moves in the second transverse hole, the engaging member having a bar which is perpendicular to the first and second ends, the bar extending out from the through hole and engaged with the engaging hole of the fixed part.

2. The expandable armrest of wheel chair as claimed in claim 1, wherein the fixed part has a first pad connected thereto.

3. The expandable armrest of wheel chair as claimed in claim 1, wherein the movable part has a second pad connected thereto.

4. The expandable armrest of wheel chair as claimed in claim 1, wherein the first pivotal portion has a connection member.

* * * * *